US011213084B2

(12) United States Patent
Zhou

(10) Patent No.: US 11,213,084 B2
(45) Date of Patent: Jan. 4, 2022

(54) TIGHTNESS ADJUSTING DEVICE, COAT AND PANTS

(71) Applicant: Hubei OTT Materials Technology Corp., Ltd., Xiaogan (CN)

(72) Inventor: Wangping Zhou, Yingcheng (CN)

(73) Assignee: HUBEI OTT MATERIALS TECHNOLOGY CORP., LTD., Xiaogan (CN)

( * ) Notice: Subject to any disclaimer, the term of this patent is extended or adjusted under 35 U.S.C. 154(b) by 0 days.

(21) Appl. No.: 17/098,225

(22) Filed: Nov. 13, 2020

(65) Prior Publication Data

US 2021/0368902 A1 Dec. 2, 2021

(30) Foreign Application Priority Data

May 27, 2020 (CN) ..... 202010460014.7

(51) Int. Cl.

| | |
|---|---|
| ***A41F 9/02*** | (2006.01) |
| ***A42B 1/22*** | (2006.01) |
| ***A41F 1/00*** | (2006.01) |
| ***A44B 19/26*** | (2006.01) |
| *A41D 1/06* | (2006.01) |
| *A41D 3/02* | (2006.01) |

(52) U.S. Cl.

CPC ..... *A41F 9/025* (2013.01); *A41F 1/008* (2013.01); *A42B 1/22* (2013.01); *A44B 19/262* (2013.01); *Y10T 24/2561* (2015.01); *Y10T 24/2586* (2015.01)

(58) Field of Classification Search

CPC ..... A44B 19/262; A44B 19/346; A41F 1/008; Y10T 24/2586; Y10T 24/2561; A42B 1/22

See application file for complete search history.

(56) References Cited

U.S. PATENT DOCUMENTS 9,169,583 B2 * 10/2015 Hasegawa ..... A44B 19/346
2012/0180273 A1 * 7/2012 Keyaki ..... E04H 15/322 24/429

* cited by examiner

*Primary Examiner* — Robert Sandy
(74) *Attorney, Agent, or Firm* — Chun-Ming Shih; Lanway IPR Services

(57) ABSTRACT

The disclosure provides a tightness adjusting device, including an adjustable rope, two toothed straps, and a slide fastener fitting with the two toothed straps, wherein each of the toothed straps includes a woven strap and a teeth row arranged on a work side of the woven strap, the slide fastener defines two passages therein, the two teeth rows stretch into the two passages respectively, the two passages are converged at least on a first end to form a tightening passage, the slide fastener is also provided with a separating block, the separating block is arranged between the two passages, the separating block is provided with a separating cone of which a tip end is toward the tightening passage, the separating cone is one-to-one corresponding to the tightening passage, and the adjustable rope is in connection with the slide fastener. With such arrangement, the tightness adjusting device provided in the disclosure can have the adjustable rope arranged in the interior completely, with a simple and compact structure; the adjustable rope in the interior can be tightened or loosened through pulling the slide fastener; in addition, when the tightness adjusting device provided in the disclosure is used to adjust tightness, it is only needed to pull the slide fastener, and single hand operation is enough.

5 Claims, 5 Drawing Sheets

TIGHTNESS ADJUSTING DEVICE, COAT AND PANTS

TECHNICAL FIELD

The disclosure relates to the technical field of clothing, in particular to a tightness adjusting device, a coat and a pants.

BACKGROUND

In cold areas or in winters, people often choose to wear down coats or waterproof jackets. In order to protect against wind and rain and to enhance insulation performance, down coats or waterproof jackets and the like generally are provided with hats on the back, and adjustable ropes are generally arranged inside the opening edges of the hats; through pulling the adjustable rope and fastening it via buckles, the size of the hat opening may be adjusted, so that the hat opening fits the human face to increase the insulation effect. In the prior art, the adjustable rope in the above adjustment method needs to be partially exposed out of the opening edge for a user to pull; after the adjustable rope is tightened, the exposed part will stretch longer and looks much cumbersome; moreover, the pulling action often needs double hands operation, which is inconvenient. Therefore, it is needed to solve the problems in the prior art that the tightness adjusting device of the hat looks cumbersome after tightened and it is inconvenient to operate.

SUMMARY

The technical problem to be solved by the disclosure is to provide a tightness adjusting device which is compact in structure and is convenient to operate.

In order to solve the above problems, the disclosure provides a tightness adjusting device, which includes an adjustable rope, two toothed straps, and a slide fastener fitting with the two toothed straps, wherein each of the toothed straps includes a woven strap and a teeth row arranged on a work side of the woven strap, the slide fastener defines two passages therein, the two teeth rows stretch into the two passages respectively, the two passages are converged at least on a first end to form a tightening passage, the slide fastener is also provided with a separating block, the separating block is arranged between the two passages, the separating block is provided with a separating cone of which a tip end is toward the tightening passage, the separating cone is one-to-one corresponding to the tightening passage, the adjustable rope is in connection with the slide fastener, and when the slide fastener moves along the toothed strap, the slide fastener makes the adjustable rope tightened or loosened.

Preferably, the two passages are also converged on a second end to form a tightening passage.

Preferably, the slide fastener defines a first clamp groove, and the adjustable rope is clamped in the first clamp groove.

Preferably, the slide fastener is provided with a pull tab for a user to pull.

Preferably, the slide fastener defines a second clamp groove, and the pull tab is rotatably clamped in the second clamp groove.

Preferably, the adjustable rope is an elastic adjustable rope.

The disclosure also provides a coat, which includes a hat, the hat an opening edge provided with a tightness adjusting device, the tightness adjusting device is the one described according to the claims, the adjustable rope of the tightness adjusting device is arranged on the opening edge of the hat and extends along the opening edge of the hat, at least one end of the adjustable rope is in fixed connection with the hat, and the two woven straps are both in fixed connection with the hat.

Preferably, the hat is provided with the tightness adjusting device on an exterior of a position corresponding to the human head, so as to adjust the position of a brim of the hat, at least one end of the adjustable rope is in fixed connection with the hat, and the two woven straps are both in fixed connection with the hat.

Preferably, the coat also includes two sleeves, the two sleeves are both provided with the tightness adjusting device, the adjustable rope of the tightness adjusting device extends along the length direction of the sleeve, at least one end of the adjustable rope is in fixed connection with the sleeve, and the two woven straps are both in fixed connection with the sleeve.

The disclosure also provides a pants, the pants have a waist provided with the tightness adjusting device, so as to adjust the tightness of the waist through the tightness adjusting device, and the tightness adjusting device is the one described according to the claims.

According to the technical scheme provided by the disclosure, a tightness adjusting device includes an adjustable rope, two toothed straps, and a slide fastener fitting with the two toothed straps, wherein each of the toothed straps includes a woven strap and a teeth row arranged on a work side of the woven strap, the slide fastener defines two passages therein, the two teeth rows stretch into the two passages respectively, the two passages are converged at least on a first end to form a tightening passage, the slide fastener is also provided with a separating block, the separating block is arranged between the two passages, the separating block is provided with a separating cone of which a tip end is toward the tightening passage, the separating cone is one-to-one corresponding to the tightening passage, the adjustable rope is in connection with the slide fastener, and when the slide fastener moves along the toothed strap, the slide fastener makes the adjustable rope tightened or loosened. The tightness adjusting device is arranged at a position where the tightness needs to be adjusted, for example, the tightness adjusting device is arranged on the opening edge of a hat, the adjustable rope extends along the opening edge of the hat, at least one end of the adjustable rope is fixedly arranged, the two woven straps are arranged on the opening edge and extend along the same direction as the adjustable rope, and through pulling the slide fastener, the slide fastener moves along the toothed strap and thus makes the adjustable rope tightened or loosened. Compared with the drawstring arrangement in the prior art in which partial of the adjustable rope needs to be exposed outside and consequently looks cumbersome, the tightness adjusting device provided in the disclosure can have the adjustable rope arranged in the interior completely, with a simple and compact structure; the adjustable rope in the interior can be tightened or loosened through pulling the slide fastener; in addition, when the tightness adjusting device provided in the disclosure is used to adjust tightness, it is only needed to pull the slide fastener, and single hand operation is enough.

BRIEF DESCRIPTION OF THE DRAWINGS

For a better understanding of the embodiments of the disclosure or the technical scheme in the prior art, accompanying drawings needed in the description of the embodiments or the prior art are simply illustrated below. Obviously, the accompanying drawings described below are some embodiments of the disclosure. For the ordinary skill in the field, other accompanying drawings may be obtained according to the structure shown in these accompanying drawings without creative work.

Description of reference numbers in FIG. 1 to FIG. 7:

1 represents an adjustable rope, 2 represents a slide fastener, 3 represents a woven strap, 4 represents a teeth row, 5 represents a tightening passage, 6 represents a separating block, 7 represents a first clamp groove, 8 represents a pull tab, 9 represents a second clamp groove, and 10 represents a locking plate.

DESCRIPTION OF THE EMBODIMENTS

The above purpose, technical scheme and advantages of the disclosure will become more clearly understood from the detailed description of the technical scheme of the disclosure. Obviously, the embodiments described hereinafter are simply part embodiments of the disclosure, but all the embodiments. All other embodiments obtained by those skilled in the art based on the embodiments in the disclosure without creative work are intended to be included in the scope of protection of the disclosure.

These embodiments provide a tightness adjusting device which is simple and compact in structure and convenient to operate.

Hereinafter embodiments are described with reference to accompanying drawings. The embodiments described below have no limitations to the contents of the invention recorded in the claims appended herein. In addition, the entirety of the constitution represented by the following embodiments is not limited to what required by a solution to the invention recorded in the claims appended herein.

Figure 1:
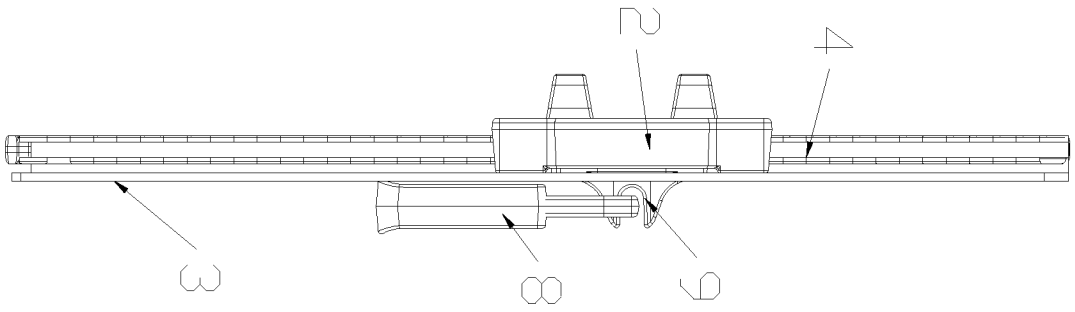
FIG. 1 is a structure diagram of a tightness adjusting device according to an embodiment of the disclosure.
Figure 2:
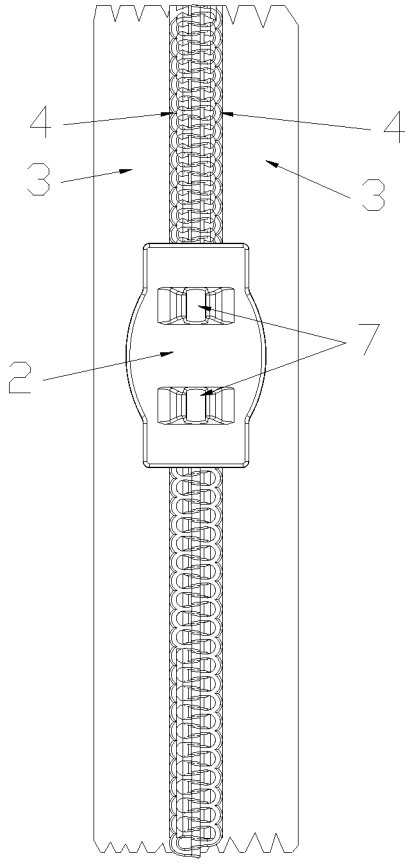
FIG. 2 is a left view of the tightness adjusting device shown in FIG. 1.
Figure 3:
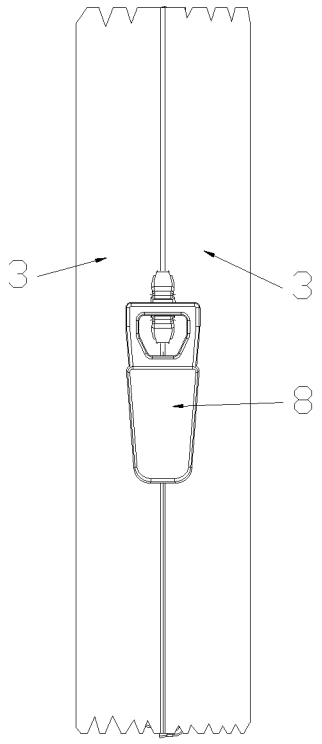
FIG. 3 is a right view of the tightness adjusting device shown in FIG. 1.
Figure 4:
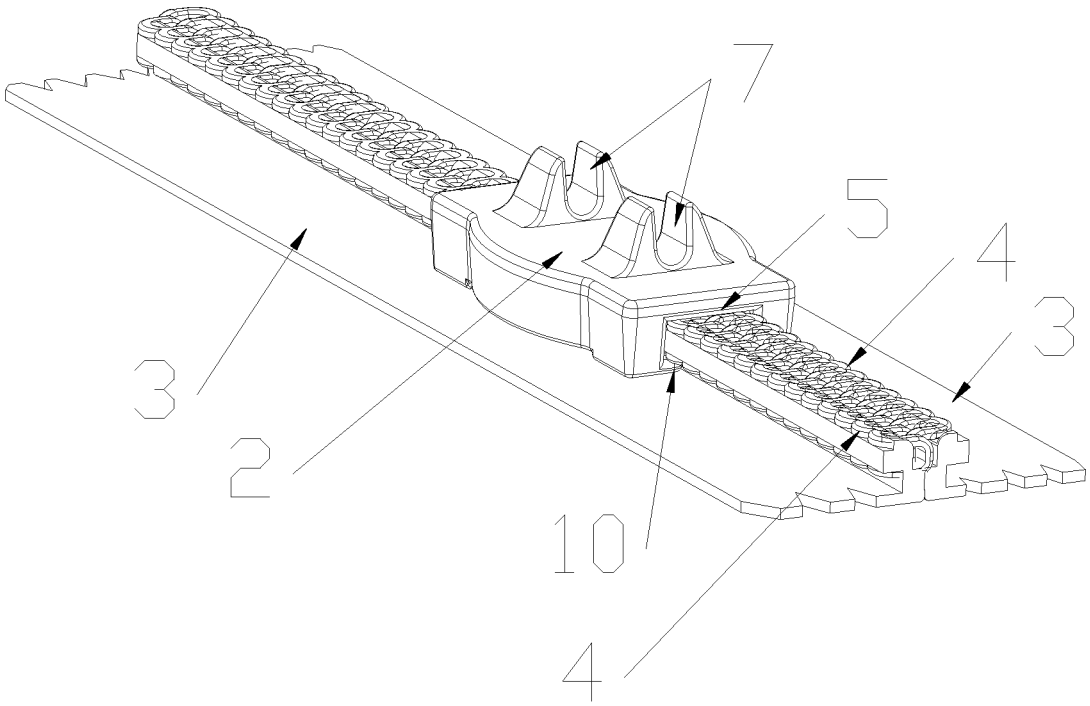
FIG. 4 is a perspective view of the tightness adjusting device shown in FIG. 1.
Figure 5:
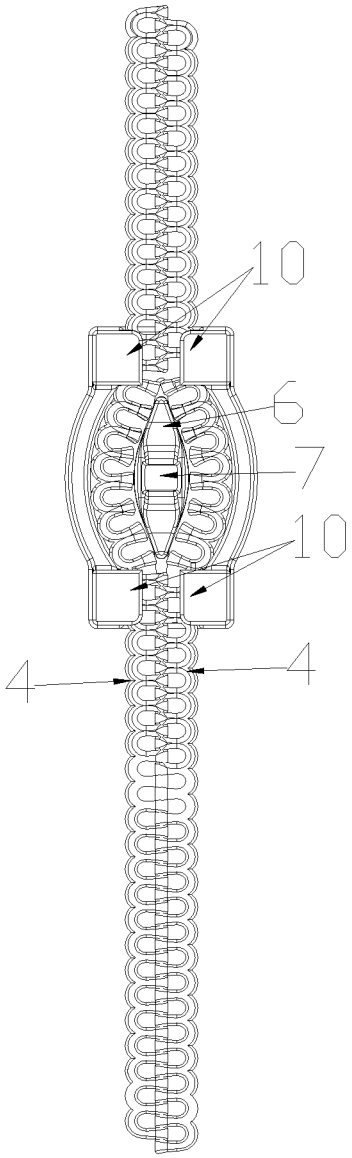
FIG. 5 is a fit diagram of the slide fastener and the teeth row shown in FIG. 1.
Figure 6:
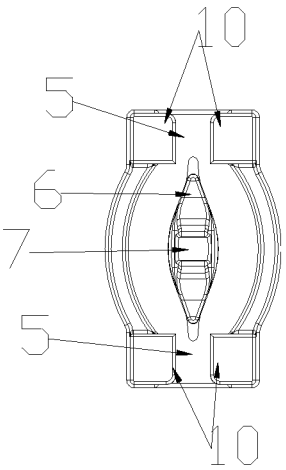
FIG. 6 is a structure diagram of the slide fastener shown in FIG. 1.
Figure 7:
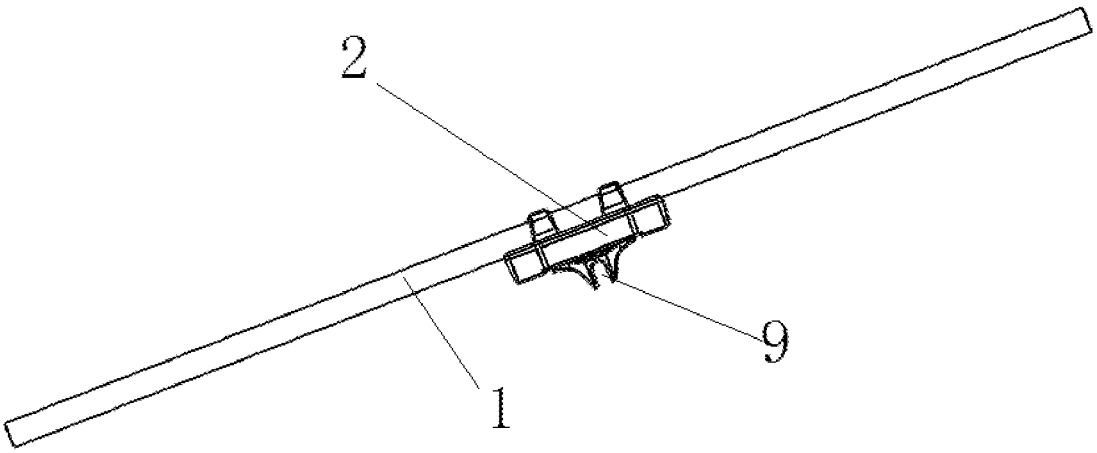
FIG. 7 is a structure diagram of an adjustable rope and a slide fastener according to an embodiment of the disclosure.

Referring to FIG. 1 to FIG. 7, the embodiment of the disclosure provides a tightness adjusting device, including an adjustable rope 1, two toothed straps, and a slide fastener 2 fitting with the two toothed straps. Each of the toothed straps includes a woven strap 3 and a teeth row 4 arranged on a work side of the woven strap 3, and the woven strap 3 is in fixed connection with clothing, for example, connecting through stitching. As shown in FIG. 2, the work side of the woven strap 3 refers to one side of the woven strap 3 which faces the other woven strap 3, two teeth rows 4 both include a plurality of teeth distributed along the work side, and the teeth on the two teeth rows 4 can be meshed with each other. Referring to FIG. 5 to FIG. 6, the slide fastener 2 defines two passages therein, the two teeth rows 4 stretch into the two passages respectively, the two passages are converged at least on a first end of the slide fastener 2 to form a tightening passage 5, and when the two teeth rows 4 pass through the tightening passage 5, the teeth on the two teeth rows 4 are meshed with each other due to the squeezing of the tightening passage 5. Referring to FIG. 4 to FIG. 6, the teeth may be in fixed connection with the woven strap 3 through stitching, the teeth on the two woven straps 3 are respectively arranged on planes of two opposite sides of the two woven straps 3, and a certain gap is defined between the teeth of the toothed row and the plane of the woven strap 3, the slide fastener 2 is provided with a locking plate 10 at least at the tightening passage 5, and when the teeth rows 4 stretch into the tightening passage 5, the locking plate 10 is clamped in the gap between the teeth and the plane of the woven strap 3, preventing the slide fastener 2 falling off the teeth rows 4; as shown in FIG. 3, in actual use, the one plane with teeth rows 4 is arranged inside clothing, in such way most part of the slide fastener 2 is located inside clothing too, with only a small part exposed outside, which makes the whole clothing compact and tidy. The slide fastener 2 is also provided with a separating block 6, the separating block 6 is arranged between the two passages, the separating block 6 is provided with a separating cone of which a tip end is toward the tightening passage 5, the separating cone is one-to-one corresponding to the tightening passage 5, and when two meshed teeth rows 4 enter the slide fastener 2 from the tightening passage 5, they are separated due to the function of the separating cone. As shown in FIG. 7, the adjustable rope 1 is in connection with the slide fastener 2, and when the slide fastener 2 moves along the toothed strap, the slide fastener 2 makes the adjustable rope 1 tightened or loosened.

The tightness adjusting device is arranged at a position where the tightness needs to be adjusted, for example, the tightness adjusting device is arranged on the opening edge of a hat, the adjustable rope 1 extends along the edge of the hat, at least one end of the adjustable rope 1 is fixedly arranged, the two woven straps 3 are arranged on the opening edge and extend along the same direction as the adjustable rope 1, and through pulling the slide fastener 2, the slide fastener 2 moves along the toothed strap and thus makes the adjustable rope 1 tightened or loosened. Compared with the drawstring arrangement in the prior art in which partial of the adjustable rope 1 needs to be exposed outside and consequently looks cumbersome, the tightness adjusting device provided in the disclosure can have the adjustable rope 1 arranged in the interior completely, with a simple and compact structure; the adjustable rope 1 in the interior can be tightened or loosened through pulling the slide fastener 2; in addition, when the tightness adjusting device provided in the disclosure is used to adjust tightness, it is only needed to pull the slide fastener 2, which is as simple and fast as usual zipping actions; thus, single hand operation is enough.

In some embodiments, the two passages are also converged on a second end of the slide fastener 2 to form a tightening passage 5. Through such arrangement, wherever the slide fastener is located on the teeth rows 4, the teeth rows 4 always keep meshed regardless of whether the adjustable rope 1 is tightened or loosened, such that no gap occurs between the two teeth rows 4, ensuring the adjustable rope 1 not to be exposed from the two teeth rows 4; therefore, the entire tightness adjusting device is more compact in structure, making clothing not cumbersome for users.

In some embodiments, the slide fastener 2 defines a first clamp groove 7, and the adjustable rope 1 is clamped in the first clamp groove 7. Referring to FIG. 2, the first clamp groove 7 is arranged run-through along the extension direction of the teeth rows, the adjustable rope 1 is clamped inside the first clamp groove 7, and the width of the first clamp groove 7 should be less than the diameter of the adjustable rope 1. With such arrangement, the connection structure for the adjustable rope 1 and the slide fastener 2 is simple and is convenient to assemble. Of course, in order to prevent the adjustable rope 1 sliding relative to the first clamp groove 7, a plurality of first clamp grooves 7 may be arranged in parallel, referring to FIG. 7, for example, two first clamp grooves 7 may be arranged. In some embodiments, the adjustable rope 1 is an elastic adjustable rope 1, for example, a rubber rope.

In some embodiments, the slide fastener 2 is provided with a pull tab 8 for a user to pull. A user may adjust the position of the slide fastener 2 through pulling the pull tab 8. The arrangement of the pull tab 8 is more convenient for the user to apply a force. In other embodiments, the slide fastener 2 defines a second clamp groove 9, and the pull tab 8 is rotatably clamped in the second clamp groove 9.

The embodiment of the disclosure further provides a coat, which includes a hat. The hat has an opening edge provided with a tightness adjusting device, and the tightness adjusting device is the one described in any of the above embodiments. The adjustable rope 1 of the tightness adjusting device is arranged on the opening edge of the hat and extends along the opening edge of the hat, at least one end of the adjustable rope 1 is in fixed connection with the hat, and the two woven straps 3 are both in fixed connection with the hat. For example, the hat defines on the opening edge a rope passage for the adjustable rope 1 to pass through, the rope passage is defined extending along the opening edge of the hat, and the length of the rope passage may be consistent with the opening edge of the hat. The adjustable rope 1 is inserted into the rope passage, the rope passage defines an opening which extends along the rope passage, the length of the opening is equal that of the woven strap 3, and the two woven straps 3 are stitched on two opposite side edges of the opening respectively. Both ends of the adjustable rope 1 may be in fixed connection with the hat, and the slide fastener 2 is in connection with a certain point between the two ends of the adjustable rope 1; or, one end of the adjustable rope 1 is in fixed connection with the hat, while the other end is in connection with the slide fastener 2; the slide fastener 2 is adjusted along the teeth rows 4, so that the slide fastener 2 can drive the adjustable rope 1 to slide inside the rope passage, thereby making the hat opening bigger or smaller.

Compared with the drawstring arrangement in the prior art in which partial of the adjustable rope 1 needs to be exposed outside and consequently looks cumbersome, the hat on the coat provided in the embodiment of the disclosure can have the adjustable rope 1 arranged in the interior completely, with a simple and compact structure; the adjustable rope 1 in the interior can be tightened or loosened through pulling the slide fastener 2; in addition, when the tightness adjusting device provided in the disclosure is used to adjust tightness, it is only needed to pull the slide fastener 2, and single hand operation is enough.

In some embodiments, the hat is provided with the tightness adjusting device on an exterior of a position corresponding to the human head, so as to adjust the position of a brim of the hat, for example, preventing the brim blocking the user's sight. At least one end of the adjustable rope 2 is in fixed connection with the hat, and the two woven straps 3 are both in fixed connection with the hat. For example, the two woven straps 3 are in connection with the hat through stitching, a first end of the adjustable rope 1 is fixed with a position of the hat close to the brim, and a second end is in connection with the slide fastener 2; or a first end is fixed with a position of the hat close to the brim, and a second end is in fixed connection with the hat, while the slide fastener 2 is in connection with a certain point between the two ends. When the hat blocks the user's sight, the slide fastener 2 may be adjusted along the teeth rows 4, so that the adjustable rope 1 is tightened to get the position of the brim pulled backwards; with such arrangement, the hat can be worn on a human head stably and will not block the user's sight.

In some embodiments, the coat further includes two sleeves, the two sleeves are both provided with the tightness adjusting device, the adjustable rope 1 of the tightness adjusting device extends along the length direction of the sleeve, at least one end of the adjustable rope 1 is in fixed connection with the sleeve, and the two woven straps 3 are both in fixed connection with the sleeve. Through arranging the tightness adjusting device on the sleeves, the lengths of the sleeves can be adjusted.

The embodiment of the disclosure further provides a pants, the pants have a waist provided with the tightness adjusting device, so as to adjust the tightness of the waist through the tightness adjusting device, and the tightness adjusting device is the one described according to any one of the above embodiments. For example, the waist defines a rope passage for the adjustable rope 1 to pass through, the rope passage is defined extending along the edge of the waist, the adjustable rope 1 is inserted into the rope passage, two ends of the adjustable rope 1 are both fixed with the pants, or one end of the adjustable rope 1 is fixed with the pants, the rope passage also defines an opening which extends along the rope passage, the length of the opening is equal that of the woven strap 3, the two woven straps 3 are arranged on two opposite side edges of the opening respectively, and the slide fastener 2 is in connection with the adjustable rope 1. The tightness of the waist can be adjusted by adjusting the position of the slide fastener 2 along the teeth rows 4. With such arrangement, the tightness of the waist can be adjusted simply and fast, and no taut knot will occur on the adjustable rope 1.

The above description for the disclosed embodiments enables those skilled in the field to implement or use the disclosure. Various modifications made to these embodiments are apparent to those skilled in the field. General principles defined in this paper may be implemented in other embodiments without departing from the spirit or scope of the disclosure. Therefore, the disclosure shall not be limited to these embodiments illustrated in this paper but shall conform to the widest scope consistent with the principles and novelties disclosed in this paper.

What is claimed is:

1. A tightness adjusting device, comprising: an adjustable rope (1), two toothed straps, and a slide fastener (2) fitting with the two toothed straps, wherein each of the toothed straps comprises a woven strap (3) and a teeth row (4) arranged on a work side of the woven strap (3), the slide fastener (2) defines two passages therein, the two teeth rows (4) stretch into the two passages respectively, the two passages are converged at least on a first end to form a tightening passage (5), the slide fastener (2) is also provided with a separating block (6), the separating block (6) is arranged between the two passages, the separating block (6) is provided with a separating cone of which a tip end is toward the tightening passage (5), the separating cone is one-to-one corresponding to the tightening passage (5), the adjustable rope (1) is in connection with the slide fastener (2), and when the slide fastener (2) moves along the toothed strap, the slide fastener (2) makes the adjustable rope (1) tightened or loosened;

wherein the two passages are also converged on a second end to form a tightening passage (5).

2. The tightness adjusting device according to claim 1, wherein the slide fastener (2) defines a first clamp groove (7), and the adjustable rope (1) is clamped in the first clamp groove (7).

3. The tightness adjusting device according to claim 1, wherein the slide fastener (2) is provided with a pull tab (8) for a user to pull.

4. The tightness adjusting device according to claim 3, wherein the slide fastener (2) defines a second clamp groove (9), and the pull tab (8) is rotatably clamped in the second clamp groove (9).

5. The tightness adjusting device according to claim 1, wherein the adjustable rope (1) is an elastic adjustable rope.

* * * * *